US010376876B2

(12) United States Patent
Profitt

(10) Patent No.: US 10,376,876 B2
(45) Date of Patent: Aug. 13, 2019

(54) PIPETTE COMPONENTS USEFUL FOR MEDICAL DIAGNOSTICS

(71) Applicant: Siemens Healthcare Diagnostics Inc., Tarrytown, NY (US)

(72) Inventor: James A. Profitt, Palmer Lake, CO (US)

(73) Assignee: Siemens Healthcare Diagnostics Inc., Tarrytown, NY (US)

( * ) Notice: Subject to any disclaimer, the term of this patent is extended or adjusted under 35 U.S.C. 154(b) by 0 days.

(21) Appl. No.: 15/790,681

(22) Filed: Oct. 23, 2017

(65) Prior Publication Data

US 2018/0043348 A1 Feb. 15, 2018

Related U.S. Application Data

(62) Division of application No. 14/777,671, filed as application No. PCT/US2014/030948 on Mar. 18, 2014, now abandoned.

(Continued)

(51) Int. Cl.
*B01L 3/02* (2006.01)

(52) U.S. Cl.
CPC ..... *B01L 3/0275* (2013.01); *B01L 3/021* (2013.01); *B01L 2200/026* (2013.01);

(Continued)

(58) Field of Classification Search
CPC ..... B01L 3/02; B01L 3/0275; B01L 3/021; B01L 3/022

(Continued)

(56) References Cited

U.S. PATENT DOCUMENTS 4,309,912 A * 1/1982 Smith ..... B01L 3/0244 222/133
5,387,526 A 2/1995 Gamer et al.
(Continued)

FOREIGN PATENT DOCUMENTS

WO 0027530 A1 5/2000
WO 0029112 A1 5/2000

OTHER PUBLICATIONS

International Search Report and Written Opinion of International Application No. PCT/US2014/030948 dated Nov. 3, 2014.

(Continued)

*Primary Examiner* — Brian R Gordon
(74) *Attorney, Agent, or Firm* — Kyle D. Petaja

(57) ABSTRACT

A pipette is described having a tube, a pressure mechanism, and at least one reagent pad. The tube has a first end, a second end opposite the first end, and a sidewall extending between the first end and the second end, with the sidewall defining an interior cavity. The pressure mechanism is operably connected to the first end of the tube and is configured to enable a sample to be drawn into the interior cavity of the tube through the second end of the tube. The at least one reagent pad is positioned in the interior cavity of the tube and within a predefined liquid path whereby the sample contacts at least a portion of the at least one reagent pad when drawn into the interior cavity. In another embodiment, a pipette is described having a tube, a pressure mechanism, and a capillary positioned within the tube.

9 Claims, 8 Drawing Sheets

Related U.S. Application Data

(60) Provisional application No. 61/803,629, filed on Mar. 20, 2013.

(52) U.S. Cl.
CPC ... *B01L 2200/16* (2013.01); *B01L 2300/0825* (2013.01); *B01L 2300/0838* (2013.01); *B01L 2300/12* (2013.01); *B01L 2400/0481* (2013.01)

(58) Field of Classification Search
USPC ..... 422/524–525, 511, 513, 546
See application file for complete search history.

(56) References Cited

U.S. PATENT DOCUMENTS 6,117,394 A * 9/2000 Smith ..... B01L 3/0275 422/513
6,605,475 B1 8/2003 Taylor et al.
6,641,993 B1 * 11/2003 Jacobs ..... B01F 5/10 366/305
6,660,233 B1 12/2003 Coassin
6,673,630 B2 1/2004 Albarella
9,421,538 B1 * 8/2016 Sung ..... B01L 3/021
2002/0110817 A1 8/2002 Tajima
2008/0193995 A1 * 8/2008 Tajima ..... B01L 3/0275 435/174
2010/0172801 A1 7/2010 Pugia et al.
2010/0291588 A1 11/2010 McDevitt et al.
2011/0027906 A1 2/2011 Karg et al.
2011/0092686 A1 * 4/2011 Motadel ..... B01L 3/0275 536/23.1
2011/0107855 A1 5/2011 Motadel
2011/0129396 A1 6/2011 Fish
2012/0046618 A1 2/2012 Shams
2013/0032249 A1 2/2013 Tajima
2014/0377147 A1 * 12/2014 Sammler ..... B01L 3/0275 422/513

OTHER PUBLICATIONS

Supplementary Partial European Search Report of European Application No. 14770970.3 dated Nov. 15, 2016.
European Search Report and Written Opinion of European Application No. 14770970.3 dated Feb. 17, 2017.
European Office Action of European Application No. 14770970.3 dated Mar. 16, 2018.

* cited by examiner

PIPETTE COMPONENTS USEFUL FOR MEDICAL DIAGNOSTICS

INCORPORATION BY REFERENCE

This application is a Divisional of U.S. application Ser. No. 14/777,671, filed Sep. 16, 2015 which claims the benefit of US National Stage of International Application No. PCT/US2014/030948, filed Mar. 18, 2014. The International Application claims the benefit of U.S. Provisional Application No. 61/803,629, filed Mar. 20, 2013. All of the applications are incorporated by reference herein in their entirety.

FIELD OF THE DISCLOSURE

This disclosure relates to pipettes for aspirating, diluting and dispensing fluids, especially samples of bodily fluids for medical diagnostic purposes.

BACKGROUND

Pipettes are common tools used in medical diagnostic laboratories to transport measured volumes of bodily fluid samples, such as blood and urine. There are many different styles of pipettes that work by different mechanisms, most commonly piston driven pipettes and vacuum assisted pipettes. Generally, pipettes have a cylinder, graduated or not, that can be filled with a fluid using a pressure mechanism on one end of the cylinder. Disposable and single use pipettes are often made of polyethylene.

There is a need for improved pipettes that can do more than just transfer measured volumes of sample. Specialized syringes or pipettes that can also perform a function such as conduct a chemical analysis of some of the properties of the sample or dilute a sample are the subject of the present application.

Urinary dip strips are in common usage. Small improvements to ergonomics, handling ease and general efficiency can be very significant because so many of these manual tests are done. Samples are commonly collected from wide-mouth containers, such as cups. Fluid is then poured into a test tube (unless a very large volume of urine has been collected). A dip strip is then inserted in the test tube to contact all reactive paper pads, then it is removed and either held in the hand or placed on an absorbent paper while color develops.

Some analytical methods require high dilution factors. Assay of Hemoglobin A1c in blood is one example. The high dilution requirement can have several reasons but a typical reason is to reduce the interference that can result from high concentration of some components other than the target of the assay. Samples are commonly serially diluted, so that a small volume is diluted with a larger one; then a small portion of this solution is subsequently diluted with a larger portion of diluent. An example is the Siemens DCA Vantage® HbA1c assay, in which a small capillary is loaded with blood sample and then positioned in a cassette and during the assay process fluid is flooded into the corner of the cassette containing the pipette. There is a need for a more simple dilution process.

SUMMARY

In a first embodiment, the disclosure includes a syringe or a pipette having a pressure mechanism operatively connected to one end of a cylinder. Pipette and syringe are used interchangeably throughout the application. The cylinder includes a reagent test pad within which after reacting with a sample fluid indicates the presence or level of an analyte in a bodily fluid. The cylinder is substantially transparent or has a transparent portion which allows the result of the reagent pad to be viewed. It should be understood that the disclosure includes alternatives to a cylindrical tube where cross sections, for example rectangular or triangular, could be of a geometry most useful for the usability, economic manufacture, or robustness of the device.

Another aspect of the disclosure relates to an improved urine dip strip. A urine dip strip, for example (Multistix® 10 SG by Siemens Healthcare Diagnostics), is inserted within a disposable pipette or syringe. The pipette functions normally with the strip inside and all reagent pads are easily contacted with sample. Color change of the reagent pads are observed through the transparent pipette material. No transfer from the original container to an intermediary tube is required. Waste may be returned immediately to the source container. The disclosure allows a reduced volume compared to standard urine dip tubes (about 2 mL in the pipette vs. about 10 mL in a skinny urine tube). A convenience is also realized by not having to transfer urine from a collection cup to a thin sample tube. Another convenience is that there is the option to stand the strip vertically once it has been wetted. Also, the drained pipette with strip is more rigid and accumulates less external fluid than a dipped strip. This makes its usage less messy.

There could be several variations leading to a strip in a transparent or translucent container. In one embodiment, both ends of the tube are open to air. The squeezable portion can be squeezed, the top end of the tube may be temporarily closed, and then the squeeze released to allow fluid to be drawn in; or an external vacuum source could be applied, perhaps via syringe or pump. This configuration would allow the tube to drain by breaking the seal on the top of the tube, rather than squeezing a bulb and exuding the fluid. In another embodiment, webs or chains of tubes or pipettes with strips could be employed in an automated instrument, allowing sampling from a rack of samples, followed by automated analysis.

A method is also disclosed including the steps of:

aspirating fluid into a pipette containing at least one reagent pad up to a fill line;

dispensing fluid out of the pipette; and reading the result of the reagent pad.

The diagnostic indicator could be a urine strip with at least one reagent pad. Alternatively at least one reagent pad could be affixed directly to an interior portion of the tube. The fill line ensures that enough volume of sample was aspirated to cover and react with the reagent pad. The reading could be carried out in an automated manner with an analyzer such as the Clinitek Status® analyzer (Siemens Healthcare Diagnostics) or any other camera and processor with appropriate algorithms to decode the color change of the reagent pad. It should be noted that a translucent pipette tube, such as those obtained through polyethylene molding, can still be precise for instrumental optical measurement, especially if a difference is monitored, such as color change at two different time points or as a difference in dry versus wet developed color. Alternatives to the diagnostic indicator in unitized pipette could simply divide the design into separate combinations of tip, tube, bulb and indicator unit. For example, in an automated system a strip could be allowed to fall into an optically clear rectangular chamber with a tip which is a ported cone or hollow needle. Replacement of the bulb with another mechanism for aspiration and dispense is consistent with the disclosure.

Another embodiment of the disclosure is a pipette which unitizes the dilution process. A capillary of defined small volume is positioned within a pipette tip using a small holder for the capillary. This holder could be integrated into the molded pipette tip or other affixed therein. The disclosure presents options for a dilution processes which can be used to increase user convenience, decrease number of disposables or ease automated operations. Though the capillary could be mounted in a pipette with squeezable integrated bulb, the preferred design is based upon dimensions for a pipette tip of a type meant for common handheld laboratory pipettors (supplying the air seal and pressure/vacuum for fluid transfers). These same tips are used in instrument or robotic dilution systems. The configuration of the demonstrated disclosure should be fully usable in either manual or automated methods. The secured capillary may also be enclosed in a tube which bridges the aspiration/dispense device and a common pipette tip or needle. This variation may be more versatile or economic for automated, high throughput systems, where use of mass-produced components such as a tip or a needle is an advantage.

Another aspect of the disclosure is that dilutions could be done serially. At the end of the first cycle of dilution, the capillary in the empty pipette tip contains diluted solute in solution. Introduction of a new load of diluent can produce a further dilution of the solution without having to change pipette tips. The HbA1c assay is one of the immunoassays that performs best with precise, high dilution of sample. By adding the microcapillary used in the present disclosure to a pipette tip, it becomes possible to make precise dilutions using the dispenser. Sample can be drawn into contact with the capillary and excess expelled. Diluent can be brought in from the top or also drawn up, so that it surrounds the capillary. Small suction/pressure cycles can be used to mix the capillary contents with the tip fluid and all or part of the total fluid expelled for use as a diluted sample.

An exemplary method includes:

50 microliter dye+water, capillary fills;

fluid expelled, capillary holds full small volume;

80 microliter diluent water taken in+20 microliter air. Concentrated dye moves out of capillary, mixed, capillary refilled and fluid expelled;

Repeat with more diluent as necessary;

capillary has diluted fluid inside;

Capillary fluid is expelled

The capillary may be expelled by bringing fluid to both its ends, thereby releasing the capillary force. Fluid is held tightly in a capillary when the ends have at least one fluid/air interface, but when both ends have a fluid/fluid interface (if both hydrophilic) then capillary action is lost and the contents of the capillary migrate easily. The pipette may include assortments of combinations in sizes of capillaries and pipette tips or multiple capillaries within the tip. The pipette may be used for mixing solutions for chemical reaction, or for reacting to fluids where the second load of diluent contains chemicals which are reactive with those of the first dilution. The pipette tip may be long and have capillaries positioned along the interior length of the pipette with a defined distance between them, and fluid is caused to mix in stages as it is drawn up the pipette tip. The fluid may be expelled and replaced with a different fluid which is caused to move to upper capillaries. Another embodiment includes a capillary containing a dried or lyophilized or encapsulated substance to be diluted.

Example: The strip/pipette solution of the present invention disclosure was used to do a spectroscopic demonstration of function. A 2 microliter portion of the stock was mixed with 98 microL of water as a control and the water blanked spectrum taken in a 1 mL quartz cuvette on an HP 8453 spectrophotometer. A dilution tip was assembled using one of the holders of the present invention disclosure. Using a 100 microL microliter Rainien pipettor, a 50 microliter portion of the stock was taken into the tip to just contact the capillary end and then was expelled. All of the air was expelled and an 80 microliter portion of water was taken in, completely immersing the capillary and internal holder. The pipettor dial was adjusted to 100 in air, pulling in about 30 microL air. The pipettor plunger was depressed partly and released several times to allow fluids to mix. The 80+microliter contents were expelled into 920 microliter water and mixed and the spectrum taken. As shown in FIG. 13, the spectra were very similar, showing a similar dilution (50 fold) was attained.

In some embodiments, the present disclosure describes a pipette having a tube, a pressure mechanism and at least one reagent pad. The tube has a sidewall defining an interior cavity. The pressure mechanism is operably connected to the tube. The pressure mechanism is configured to enable a sample to be drawn into the interior cavity of the tube through an opening of the tube. The at least one reagent pad is positioned in the interior cavity of the tube and within a predefined liquid path whereby a sample contacts at least a portion of the at least one reagent pad when drawn into the interior cavity.

In some embodiments, the present disclosure describes a reagent pipette tip having a tube, and at least one reagent pad. The tube has a first end, a second end opposite the first end, and a sidewall extending between the first end and the second end defining an interior cavity. A portion of the tube is configured to be connected to a pipette such that when a sample is drawn into the pipette, the sample is drawn through the tube in a liquid path. The at least one reagent pad is positioned within the interior cavity of the tube and in the liquid path whereby a sample contacts at least a portion of the at least one reagent pad when drawn into the interior cavity.

In some embodiments, the present disclosure describes a pipette having a tube, a pressure mechanism and a capillary. The tube has a first end, a second end opposite the first end, and a sidewall extending between the first end and the second end. The sidewall defines an interior cavity. The pressure mechanism is operably connected to a first portion of the tube. The pressure mechanism is configured to enable a sample to be drawn into the interior cavity of the tube through a second portion of the tube. The capillary is positioned within the interior cavity of the tube between the first portion and the second portion and in a predefined liquid path between the first and second portions.

In some embodiments, the present disclosure describes a diluent pipette tip having a tube, a capillary holder and a capillary. The tube has a first end, a second end opposite the first end, and a sidewall extending between the first end and the second end defining an interior cavity. A connection member of the tube is configured to be connected to a pipette such that when a sample is drawn into the pipette, the sample is drawn in a liquid path through the tube. The capillary holder is positioned within the interior cavity of the tube and in the liquid path, the capillary holder has a capillary receiving area and one or more connection members extending outwardly from the capillary receiving area towards the sidewall of the tube. The capillary is positioned within the capillary receiving area and in the liquid path.

In some embodiments, the present disclosure describes a diluent tip having a tube and a capillary. The tube has a first end, a second end opposite the first end, a sidewall extending between the first end and the second end defining an interior cavity and a connection member configured to connect the tube to a pipette. The capillary is suspended within the interior cavity such that a fluid passing through the interior cavity contacts one or more capillary ends of the capillary.

In some embodiments, the present disclosure describes a method. In such method, a sample of fluid is transferred (e.g., drawn) into an interior cavity of a tube of a pipette such that the sample is in contact with at least a portion of at least one reagent pad positioned within the interior cavity of the pipette. The sample is expelled from the interior cavity of the pipette, and a result is read through the tube of the pipette.

In some embodiments, the present disclosure describes a method in which a fluid is transferred (e.g., drawn) into an interior cavity of a pipette to contact a first capillary end of a capillary and avoid a second capillary end of the capillary such that a known volume of the fluid is drawn into the capillary by a capillary force. The fluid is expelled from the interior cavity of the pipette while maintaining the known volume of the fluid within the capillary. A known volume of a diluent is introduced into the interior cavity of the pipette such that the diluent contacts the first and second capillary ends of the capillary within the interior cavity whereby the known volume of the diluent and the known volume of the sample mix to form a diluted sample, and the diluted sample is expelled from the interior cavity of the pipette.

BRIEF DESCRIPTION OF THE DRAWINGS

A more complete appreciation of the present disclosure and many of the attendant advantages thereof will be readily understood by reference to the following detailed description when taken in conjunction with the accompanying drawings, in which:

FIG. 4-1-4-4 show a reagent pipette tip in accordance with some embodiments of the present disclosure:

FIG. 4-1 shows an exploded view of a reagent pipette tip with a reagent pad, in accordance with some embodiments of the present disclosure;

FIG. 4-2 shows a top plan view of the reagent pipette tip of FIG. 4-1 taken along line 4-2;

FIG. 4-3 shows a side elevational view of the reagent pipette tip and the reagent pad of FIGS. 4-1; and FIG. 4-4 shows a side elevational view of a pipette assembly comprising the reagent pipette tip of FIG. 4-1 connected to a pipette.

FIG. 9-1-9-3 show embodiments of the diluent pipette tip of FIG. 8:

FIG. 9-1 shows a side elevational view of the diluent pipette tip of FIG. 8 with a friction fit connector;

FIG. 9-2 shows a top plan view of the diluent pipette tip of FIG. 8 with a threaded connector; and FIG. 9-3 shows a perspective view of the diluent pipette tip of FIG. 9-2.

FIGS. 10-1 and 10-2 show a capillary holder and capillary in accordance with some embodiments of the present disclosure:

FIG. 10-1 shows a side elevational view of a capillary holder and a capillary in accordance with the present disclosure; and FIG. 10-2 shows a top plan view of the capillary holder and the capillary of FIG. 10-1.

DETAILED DESCRIPTION OF THE EMBODIMENTS

Specific embodiments of the inventive concepts disclosed herein will now be described in detail with reference to the accompanying drawings. Further, in the following detailed description of embodiments of the present disclosure, numerous specific details are set forth in order to provide a more thorough understanding of the disclosure. However, it will be apparent to one of ordinary skill in the art that the embodiments disclosed herein may be practiced without these specific details. In other instances, well-known features have not been described in detail to avoid unnecessarily complicating the description.

Unless expressly stated to the contrary, "or" refers to an inclusive or and not to an exclusive or. For example, a condition A or B is satisfied by anyone of the following: A is true (or present) and B is false (or not present), A is false (or not present) and B is true (or present), and both A and B are true (or present).

In addition, use of the "a" or "an" are employed to describe elements and components of the embodiments herein. This is done merely for convenience and to give a general sense of the inventive concept. This description should be read to include one or at least one and the singular also includes the plural unless otherwise stated.

The terminology and phraseology used herein is for descriptive purposes and should not be construed as limiting in scope. Language such as "including," "comprising," "having," "containing," or "involving," and variations thereof, is intended to be broad and encompass the subject matter listed thereafter, equivalents, and additional subject matter not recited or inherently present therein.

As used herein any references to "one embodiment," "an embodiment," or "some embodiments" means that a particular element, feature, structure, or characteristic described in connection with the embodiment is included in at least one embodiment. The appearances of the phrase "in one embodiment" in various places in the specification may not refer to the same embodiment.

Figure 1:
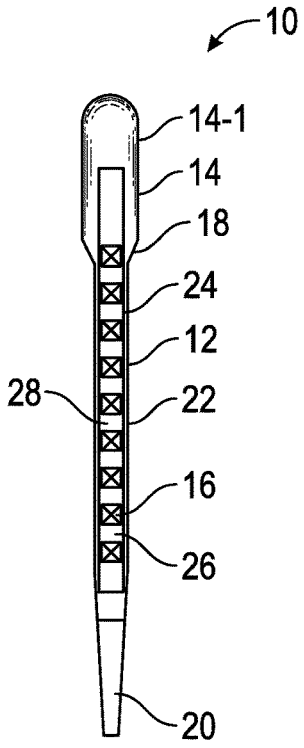
FIG. 1 is a side elevational view of a pipette in accordance with some embodiments of the present disclosure.

Referring now to FIG. 1, therein shown is a pipette 10 in accordance with some embodiments of the present disclosure. The pipette 10 comprises a tube 12, a pressure mechanism 14 operably connected and sealed to the tube 12, and at least one reagent pad 16 positioned in the tube 12. The tube 12 may include a first end 18 connected to the pressure mechanism 14, a second end 20 opposite the first end 18, and a sidewall 22 extending between the first end 18 and the second end 20. The sidewall 22 may define an interior cavity 24 with the first end 18 and the second end 20 being open. In some embodiments, at least a portion of the tube 12 may extend adjacent to the at least one reagent pad 16. For example, in some embodiments, the sidewall 22 of the tube 12 may extend in a straight line, substantially parallel to the at least one reagent pad 16 between the first end 18 and the second end 20. In some embodiments, one or more portion of the sidewall 22 may extend between the first end 18 and the second end 20 at an angle relative to the at least one reagent pad 16 causing the at least a portion of the tube 12 to taper or enlarge between the first end 18 and the second end 20. In some embodiments, the portion of the tube 12 which tapers may serve to limit movement of the at least one reagent pad 16 within the interior cavity 24 and to position the at least one reagent pad 16 within the interior cavity 24.

Figure 2:
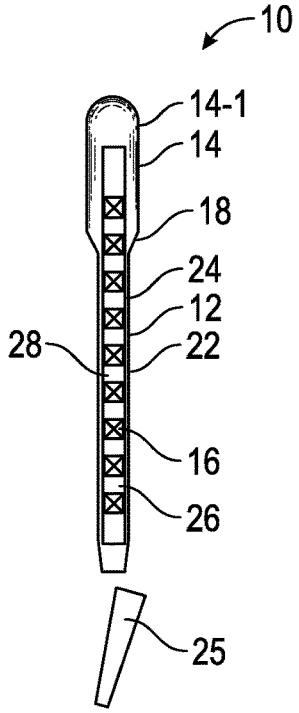
FIG. 2 shows an elevational view of the pipette of FIG. 1 with a removable tip portion, in accordance with some embodiments of the present disclosure.

In some embodiments, the tube 12 may be transparent to light within a visible spectrum such that a user may view the contents of the interior cavity 24 through at least a portion of the sidewall 22. In some embodiments, as shown in FIG. 1, the entirety of the tube 12 may be formed from a material which is transparent to light within the visible spectrum. For example, in some embodiments, the tube 12 may be formed at least in part from polyethylene, polystyrene, polyethylene terephthalate, polypropylene, glass, or other suitable materials. In some embodiments, as shown in FIG. 2, a tip portion 25 may be removably connected to the tube 12 proximate to the second end 20 of the tube 12. The tip portion 25 may be removed to permit the sample to be drawn into the tube 12, or for insertion of the at least one reagent pad 16 into the interior cavity 24 of the tube 12. In some embodiments, the tip portion 25 may be reconnected to the tube 12 after insertion of the at least one reagent pad 16 into the interior cavity 24 of the tube 12.

The pressure mechanism 14 may be operably connected to the first end 18 of the tube 12 and is adapted to supply pressure/vacuum to the tube 12 suitable for fluid transfers. In some embodiments, the pressure mechanism 14 may be configured to create a pressure differential which causes a sample to be drawn into the interior cavity of the tube 12 through the second end 20 of the tube 12. In some embodiments, the pressure mechanism 14 may be implemented as a bulb 14-1 constructed of an elastomeric material having a squeezable portion and operably connected to the first end 18 of the tube 12 to cause a partial vacuum when released. In these embodiments, the bulb 14-1 may depressed, squeezed, compressed, or otherwise manipulated to cause a partial vacuum at the first end 18 of the tube 12. Once the second end 20 of the tube 12 is placed in the sample, the compression or other manipulation of the bulb 14-1 may be released to create the partial vacuum and thereby draw at least a portion of the sample into the interior cavity 24 of the tube 12. In some embodiments, such as when the pressure mechanism 14 is implemented as a bulb, the pressure mechanism 14 may include a pressure release hole (not shown) enabling sample contained within the pressure mechanism 14 or the interior cavity 24 to be released. In use, the pressure release hole may be covered when the pressure mechanism 14 is manipulated to draw the sample into the interior cavity, thereby enabling a partial vacuum within the tube 12. The pressure release hole may then be uncovered to release the partial vacuum and thereby expel the sample out of the interior cavity 24 and/or the pressure mechanism 14.

In some embodiments, the pressure mechanism 14 may be an external vacuum source, such as a pump including an air displacement member, a positive displacement member, or other suitable member capable of drawing the sample fluid into the interior cavity 24 of the tube 12. In some embodiments, the pressure mechanism 14 may be integral to the tube 12 and formed as a single piece construction. In some embodiments, the pressure mechanism 14 may be removably connected to the tube 12. In these embodiments, after use, the tube 12 may be removed and discarded and another tube 12 may be connected to the pressure mechanism 14 to replace the discarded tube 12.

The at least one reagent pad 16 may be aligned and positioned on a substrate 26 of a test strip 28. The at least one reagent pad 16 is positioned in the interior cavity 24 of the tube 12. In some embodiments, the at least one reagent pad 16 may be positioned within a predefined liquid path within the interior cavity 24 whereby the sample contacts at least a portion of the at least one reagent pad 16 when drawn into the interior cavity 24. In some embodiments, the at least one reagent pad 16 may be affixed directly to an interior portion of the tube 12. In other embodiments, the at least one reagent pad 16 may be removable from the interior cavity 24 such that the tube 12 and the pressure mechanism 14 of the pipette 10 may be reused after the tube 12 and the pressure mechanism 14 have been cleaned and a new at least one reagent pad 16 has been positioned within the interior cavity 24.

Figure 3:
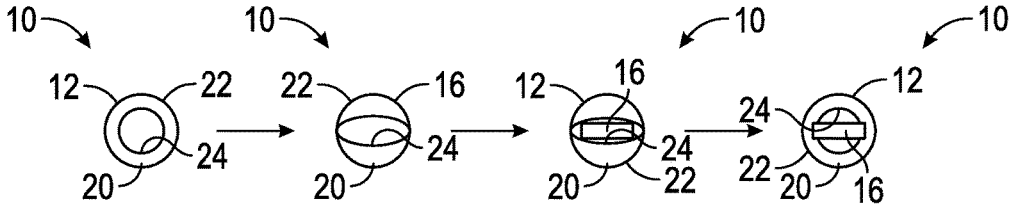
FIG. 3 shows diagrammatic depiction of a method for inserting a reagent pad into the pipette of FIG. 1.

Referring now to FIG. 3, therein shown is a method of positioning the at least one reagent pad 16 into the interior cavity 24 of the tube 12, in accordance with some embodiments of the present disclosure. As discussed below, the sidewall 22 of the tube 12 may be formed of an elastomeric material having a generally circular cross-section to facilitate the position of the at least one reagent pad 16 into the interior cavity 24. To position the at least one reagent pad 16 into the interior cavity 24 of the tube 12, the tip portion 25 is removed from the tube 12. Once the tip portion 25 is removed, the tube 12 is compressed near the second end 20 to cause a deformation of the tube 12 into an oval shape thereby laterally expanding the second end 20 of the tube 12. In at least some embodiments, the deformation and lateral expansion of the tube 12 and interior cavity 24 may be temporary, lasting only during the compression of the tube 12. The at least one reagent pad 16 may be inserted into the second end 20 of the tube 12 (which is open), thereby positioning the at least one reagent pad 16 into the interior cavity 24. The tube 12 is then released from the compression thereby allowing the tube 12 to assume its original circular shape and securing the at least one reagent pad 16 within the interior cavity 24. Once the at least one reagent pad 16 is positioned within the interior cavity 24, the tip portion 25 can be re-attached to the second end 20 of the tube 12.

In some embodiments, where the sidewall 22 of the tube 12 is not tapered prior to the tip portion 25, the at least one reagent pad 16 may be removed without compression of the tube 12. In some embodiments, the pressure mechanism 14 may be removed from the tube 12 and the at least one reagent pad 16 inserted and/or removed through the first end 18.

Figures 1, 4:
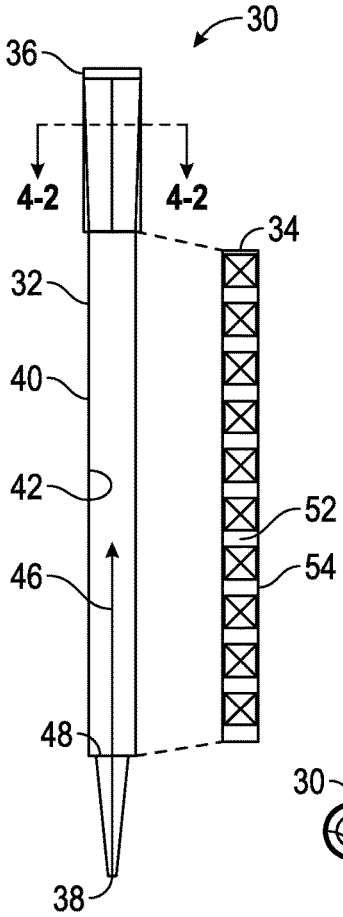
Figures 2, 4:
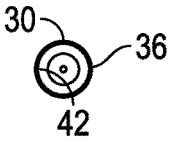
Figures 3, 4:
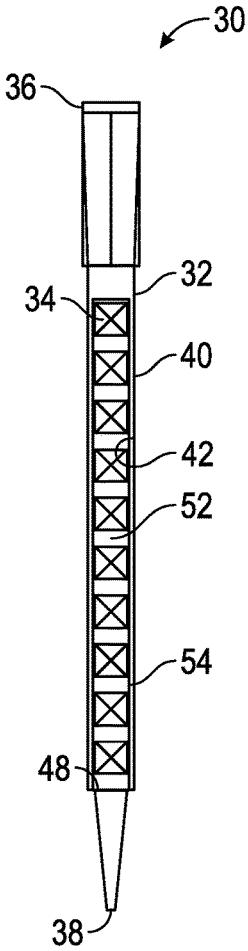
Figure 4:
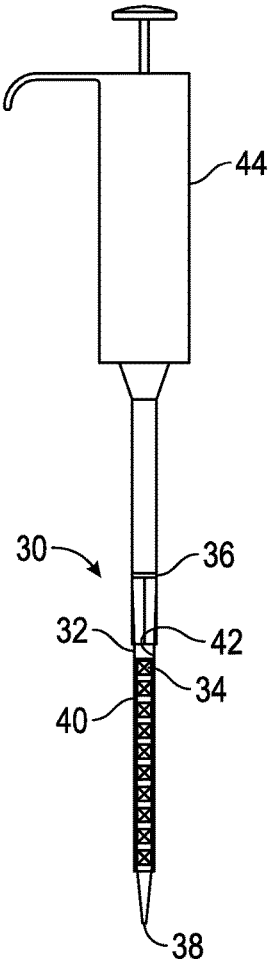

Referring now to FIGS. 4-1-4-4, therein shown is a reagent pipette tip 30, according to some embodiments of the present disclosure. The reagent pipette tip 30 may comprise a tube 32 and at least one reagent pad 34 positioned within the tube 32. The tube 32 may have a first end 36, a second end 38 opposite the first end 36, and a sidewall 40 extending between the first end 36 and the second end 38 defining an interior cavity 42. The first end 36 of the tube 32 may be configured to be connected to a pipette 44 such that when a sample is drawn into the pipette 44, the sample is drawn through the tube 32 in a predefined liquid path 46. In some embodiments, the sidewall 40 may extend adjacent to the liquid path 46 and the at least one reagent pad 34. In some embodiments, at least a portion of the tube 32 may taper, similar to the tube 12. For example, as shown in FIGS. 4-1, 4-3, and 4-4, the sidewall 40 of the tube 32 may taper proximate to the second end 38 of the tube 32.

In some embodiments, the sidewall 40 of the tube 32 may be provided with a shoulder 48 within the interior cavity 42 and proximate to the second end 38. In these embodiments, the shoulder 48 may be configured to position the at least one reagent pad 34 within the interior cavity 42 and limit movement of the at least one reagent pad 34 within the interior cavity 42.

In some embodiments, the tube 32 may include a connection member 50 proximate to the first end 36 for connecting the tube 32 to the pipette 44. In some embodiments, the connection member 50 may be a threaded connection member, snap connector, a latch, a friction fit, or other suitable connector to secure the reagent pipette tip 30 to the pipette 44. In the example shown, the connection member 50 is internal threads formed adjacent to the first end 36 of the tube 32.

In some embodiments, the tube 32 may be transparent to light within a visible spectrum such that a user (and/or an optical reader of an analyzer) may view the contents of the interior cavity 42 through at least a portion of the sidewall 40. In some embodiments, as shown in FIGS. 4-1, 4-3, and 4-4, the entirety of the tube 32 may be formed from a material which is transparent to light within the visible spectrum. For example, in some embodiments, the tube 32 may be formed at least in part from polyethylene, polystyrene, polyethylene terephthalate, polypropylene, glass, or other suitable materials.

The at least one reagent pad 34 may be implemented similarly to the reagent pad 16, e.g., positioned on a substrate 52 and aligned on the substrate 52 to form a test strip 54. The at least one reagent pad 34 is positioned in the interior cavity 42 of the tube 32 in the liquid path 46 whereby the sample contacts at least a portion of the at least one reagent pad 34 when drawn into the interior cavity 42.

The pipette 44 may be any pipette capable of receiving and/or being connected to a replaceable tip section. For example, the pipette 44 may be an automated pipette connected to a machine with a plurality of other pipettes, an air displacement pipette, a bulb pipette, a positive displacement pipette, a triggered automatic propipetter, or a button operated automatic propipetter, for example.

Figure 5:
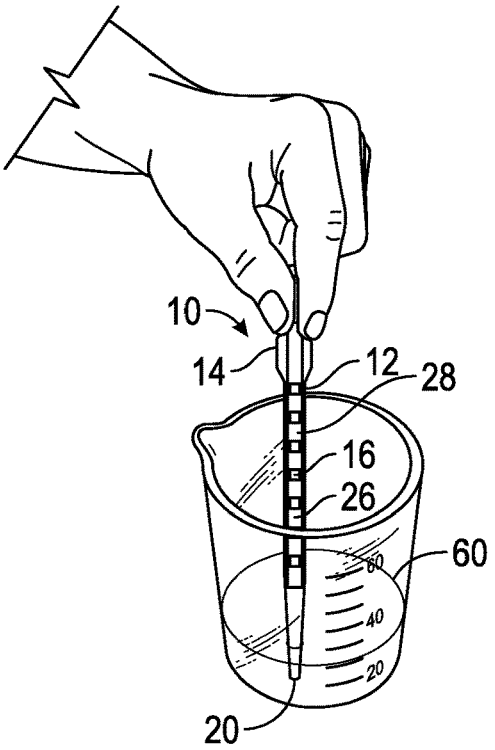
FIG. 5 shows a diagrammatic method depicting the pipette of FIG. 1 in use to wet reagent pads within the pipette with a sample.
Figure 6:
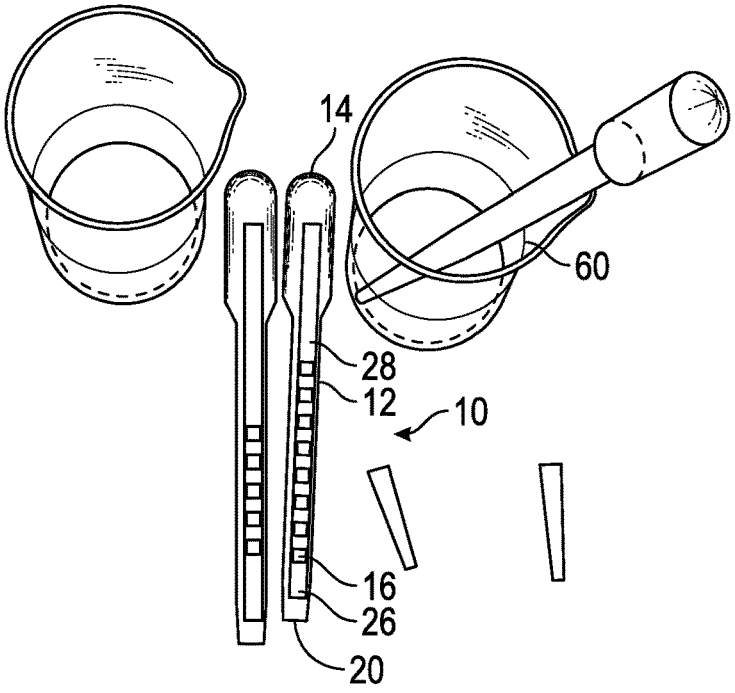
FIG. 6 shows another aspect of the diagrammatic method of FIG. 5 in which the sample is expelled from the pipette.

Referring now to FIGS. 5 and 6, shown therein is a method of using the pipette 10, in accordance with some embodiments of the present disclosure. The method shown in FIGS. 5 and 6 may also be applicable to the reagent pipette tip 30, when connected to the pipette 44. For clarity, the method will be described with reference to the pipette 10. The method may be performed by drawing a sample 60 of fluid into the interior cavity 24 of the tube 12 of the pipette 10 such that the sample is in contact with at least a portion of the at least one reagent pad 16 positioned within the interior cavity 24 of the pipette 10. The sample 60 may be drawn into the interior cavity 24 by actuating the pressure mechanism 14. For example, by compressing the pressure mechanism 14, when implemented as a bulb, placing the second end 20 of the tube 12 into the fluid and releasing compression on the pressure mechanism 14, thereby creating a partial vacuum within the tube 12 and drawing the sample 60 into the interior cavity 24. The method may further be performed by expelling the sample 60 from the interior cavity 24 of the pipette 10 and reading a result one or more times through the tube 12 of the pipette 10. When more than one reading of the result is taken, the readings can be taken at predetermined time periods such as between 1-3 minutes after the at least one reagent pad 16 has been whetted by the sample 60.

In some embodiments, as shown in FIG. 6, the result is read on the at least one reagent pad 16 through a transparent portion of the pipette 10, where at least a portion of the tube 12 of the pipette 10 is transparent to light in the visible portion of the light spectrum. The result may be a change in color of the at least one reagent pad 16. Where a plurality of reagent pads is positioned within the interior cavity 24 and contact the sample 60, the plurality of reagent pads may provide one or more results, for example, by testing for discrete properties or components within the sample 60. In some embodiments, the at least one reagent pad 16 may include one or more component mixable with the sample when the sample contacts the at least one reagent pad 16. In these embodiments, the result may be a change in a property of the sample 60 expelled from or retained within the interior cavity 24 of the pipette 10. The property may be a color, or an electrical property such as conductivity.

Figure 7:
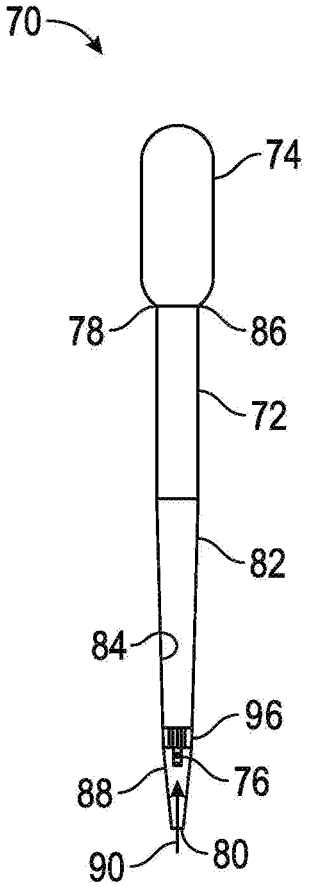
FIG. 7 shows a side elevational view of a pipette in accordance with some embodiments of the present disclosure.

Referring now to FIG. 7, shown therein is a pipette 70 in accordance with some embodiments of the present disclosure which can be used to dilute a liquid as will be described below. The liquid can be a sample of bodily fluid from a mammal, a reagent, or any other substance in a liquid form. The pipette 70 has a tube 72, a pressure mechanism 74 operably connected to the tube 72, and a capillary 76 positioned within the tube 72. The tube 72 may include a first end 78, a second end 80 opposite the first end 78, and a sidewall 82 extending between the first end 78 and the second end 80. The sidewall 82 completely or partially surrounds an interior cavity 84. In some embodiments, the sidewall 82 of the tube 72 may extend in a straight line between the first end 78 and the second end 80. In some embodiments, a first portion of the sidewall 82 of the tube 72 may extend between the first end 78 and the second end 80 at an angle with respect to a second portion of the sidewall 82 such that the first portion creates a tapered portion of the tube 72.

In some embodiments, the tube 72 may be transparent to light within a visible spectrum such that a user may view the contents of the interior cavity 84 through at least a portion of the sidewall 82. In some embodiments, the entirety of the tube 72 may be formed from a material which is transparent to light within the visible spectrum. For example, in some embodiments, the tube 72 may be formed at least in part from polyethylene, polystyrene, polyethylene terephthalate, polypropylene, glass, or other suitable materials.

The pressure mechanism 74 may be operably connected to a first portion 86 of the tube 72. The pressure mechanism 74 may be configured to enable the liquid to be drawn or pushed into the interior cavity 84 of the tube 72. For example, the pressure mechanism 74 may draw the liquid through a second portion 88 of the tube 72. In some embodiments, the pressure mechanism 74 may be implemented as a bulb which may be depressed, squeezed, compressed, or otherwise manipulated to cause a partial vacuum within the tube 72. Once the second portion 88 of the tube 72 contacts the liquid, the compression or other manipulation of the pressure mechanism 74 may be released or partially released to draw at least a portion of the liquid into the interior cavity to contact the capillary 76 for temporary storage of a predefined amount of the liquid within the capillary 76. As discussed above, the capillary 76 works under the principal of capillary force in which the liquid (also referred to as "fluid" herein) contacting one of the capillary ends 89-1 and 89-2 causes capillary force that draws liquid into a bore 89-3 of the capillary 76 while bringing liquid to both of the capillary ends 89-1 and 89-2 releases the capillary force and expels the liquid. Liquid is held tightly in the bore 89-3 of the capillary 76 when the capillary ends 89-1 and 89-2 have at least one liquid/air interface, but when both capillary ends 89-1 and 89-2 have a liquid/liquid interface (if both hydrophilic) then capillary action is lost and the contents within the bore 89-3 of the capillary 76 migrate easily. In some embodiments, the first portion 86 of the tube 72 may be the first end 78 of the tube 72 and the second portion 88 of the tube 72 may be the second end 80 of the tube 72.

In some embodiments, the pressure mechanism 74 may be an air displacement member, a positive displacement member, or other suitable member capable of drawing the portion of the liquid into the interior cavity 84 of the tube 72 to contact at least one of the capillary ends. In some embodiments, the pressure mechanism 74 may be integral to the tube 72 and formed as a single piece construction. In some embodiments, the pressure mechanism 74 may be removably connected to the tube 72. In these embodiments, after use, the tube 72 may be removed and discarded and another tube 72 may be connected to the pressure mechanism 74 to replace the discarded tube 72.

The capillary 76 may be positioned within the interior cavity 84 of the tube 72 and in a predefined liquid path 90 between the first and second portions 86 and 88. As shown in FIG. 7, the capillary 76 may be positioned adjacent to the second portion 88 of the tube 72 generally near the second end 80 thereof. The capillary 76 may have a predetermined volume, for example between 1 μL and 5 μL. In some embodiments, the capillary 76 may be a plurality of capillaries positioned within the interior cavity 84. In these embodiments, the plurality of capillaries may be positioned around the predetermined liquid path 90 such that a portion of the sample traveling along the predefined liquid path 90 may contact the plurality of capillaries. The capillary 76 may be formed from plastics, glass, or other suitable materials. For example, the capillary 76 may be formed from materials similar to those described with reference to the tube 12. The capillary 76 surrounds the bore 89-3 and is open to the surrounding atmosphere via the capillary ends 89-1 and 89-2. The capillary end 89-1 is positioned a first distance 94-1 from the second end 80 and the capillary end 89-2 is positioned a second distance 94-2 from the second end 80 so that liquid can be drawn through the second end 80 to contact only the capillary end 89-1 to store liquid within the bore 89-3, or to contact both the capillary ends 89-1 and 89-2 to expel the liquid from the bore 89-3. The second distance 94-2 is greater than the first distance 94-1 so that the capillary ends 89-1 and 89-2 can be selectively contacted with the liquid for either storing or expelling the liquid.

Figures 1, 10:
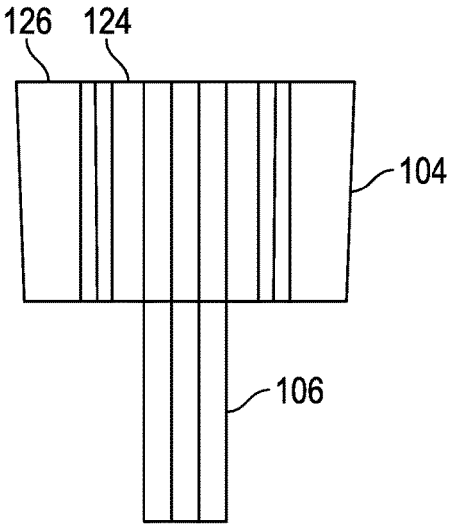
Figures 2, 10:
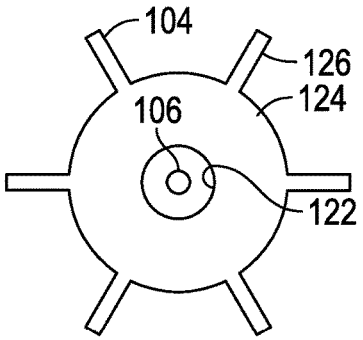

The pipette 70 is also provided with a capillary holder 96 that is positioned within the interior cavity 84 and connected to the sidewall 82 and the capillary 76. As will be discussed in more detail below with reference to FIGS. 10-1 and 10-2, the capillary holder 96 suspends the capillary 76 within the interior cavity 84 and permits fluid to flow past the capillary holder 96.

Figure 8:
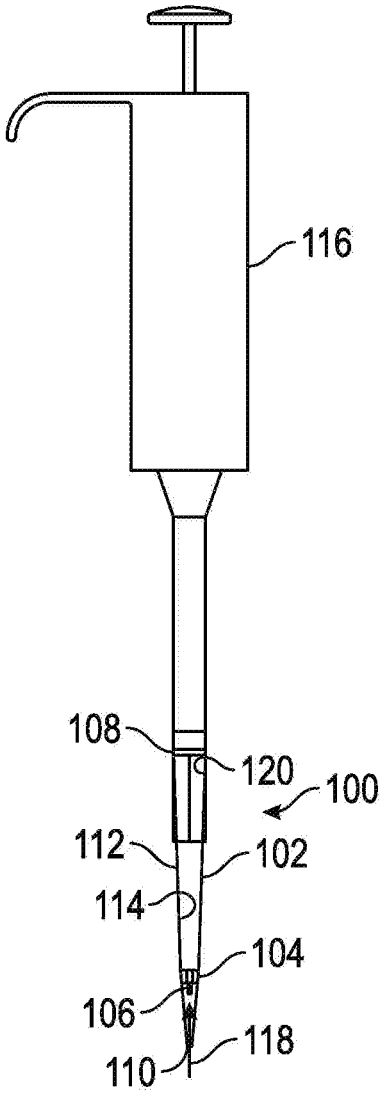
FIG. 8 shows a side elevational view of a diluent pipette tip, in accordance with some embodiments of the present disclosure connected to a pipette.
Figures 1, 9:
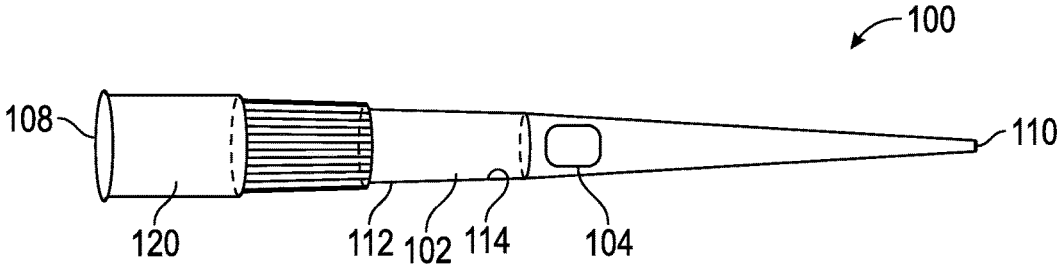
Figures 2, 9:
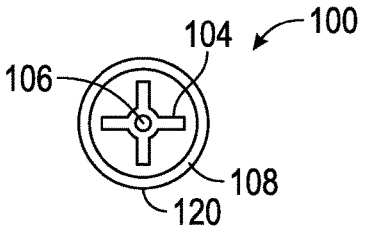
Figures 3, 9:
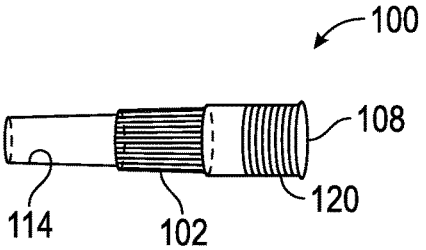

Referring now to FIGS. 8, 9-1-9-3, and 10-1-10-2, therein shown is a diluent pipette tip 100, according to some embodiments of the present disclosure. The diluent pipette tip 100 comprises a tube 102, a capillary holder 104 positioned within the tube 102 (that is similar in construction to the capillary holder 96), and a capillary 106 positioned within the capillary holder 104. The tube 102 may include a first end 108, a second end 110 opposite the first end 108, and a sidewall 112 extending between the first end 108 and the second end 110 and defining an interior cavity 114. The first end 108 of the tube 102 may be configured to be connected to a pipette 116 such that when a sample is drawn into the pipette, the sample is drawn in a liquid path 118. As shown in FIGS. 8 and 9-1, the tube 102 may include a connection member 120 proximate to the first end 108 for connecting the tube 102 to the pipette 116. The connection member 120 may be a friction fit member, as shown in FIG. 9-1; a threaded connection member, as shown in FIGS. 9-2 and 9-3; a latch member; a snap connector; or other suitable connection member capable of connecting the tube 102 to the pipette 116.

In some embodiments the tube 102 may be transparent to light within a visible spectrum such that a user may view the contents of the interior cavity 114 through at least a portion of the sidewall 112. In some embodiments, the entirety of the tube 102 may be formed from a material which is transparent to light within the visible spectrum. For example, in some embodiments, the tube 102 may be formed at least in part from polyethylene, polystyrene, polyethylene terephthalate, polypropylene, glass, or other suitable materials.

The capillary holder 104, as shown in FIGS. 8, 10-1, and 10-2, may be positioned within the interior cavity 114 of the tube 102 and in the liquid path 118. In some embodiments, the capillary holder 104 may include a capillary receiving area 122 configured to receive the capillary 106 to position the capillary within the interior cavity 114 of the tube 102. In some embodiments, the capillary 106 is formed integral to the capillary holder 104 as a single piece. In some embodiments, the capillary holder 104 may include a plurality of capillaries or a plurality of capillary receiving areas to receive a plurality of capillaries. In some embodiments, the capillary 106 or the capillary receiving area 122 may be centrally located on a center line of the interior cavity 114 extending between the first end 108 and the second end 110 of the tube 102. In some embodiments, the capillary 106 may be in a coaxial relationship with the tube 102. The capillary holder 104 may include a body 124 and a plurality of connectors 126 extending outwardly from the body 124. The connectors 126 are configured to interact with the interior cavity 114 to position the capillary holder 104 proximate to the second end 110 of the tube 102 and are spaced apart to form a channel 127 between each adjacently disposed pair of connectors 126 to permit the liquid to flow past the capillary holder 104. The capillary holder 104 may be formed of plastics similar to those materials discussed above that can be used to form the tube 102.

The capillary 106 may be suspended within the interior cavity 114 of the tube 102 and within the capillary holder 104 in the liquid path 118. The capillary 106 may have a predetermined volume. For example, the capillary 106 may have a volume between 1 μL and 5 μL. In some embodiments, the capillary 106 may be a plurality of capillaries suspended within the interior cavity 114 by the capillary holder 104 and may be positioned around the predetermined liquid path 118 such that a portion of the liquid traveling along the predetermined liquid path 118 may contact the plurality of capillaries. The capillary 106 may be formed from plastics, glass, or other suitable materials, such as those described with reference to the tube 102, for example.

Figure 11:
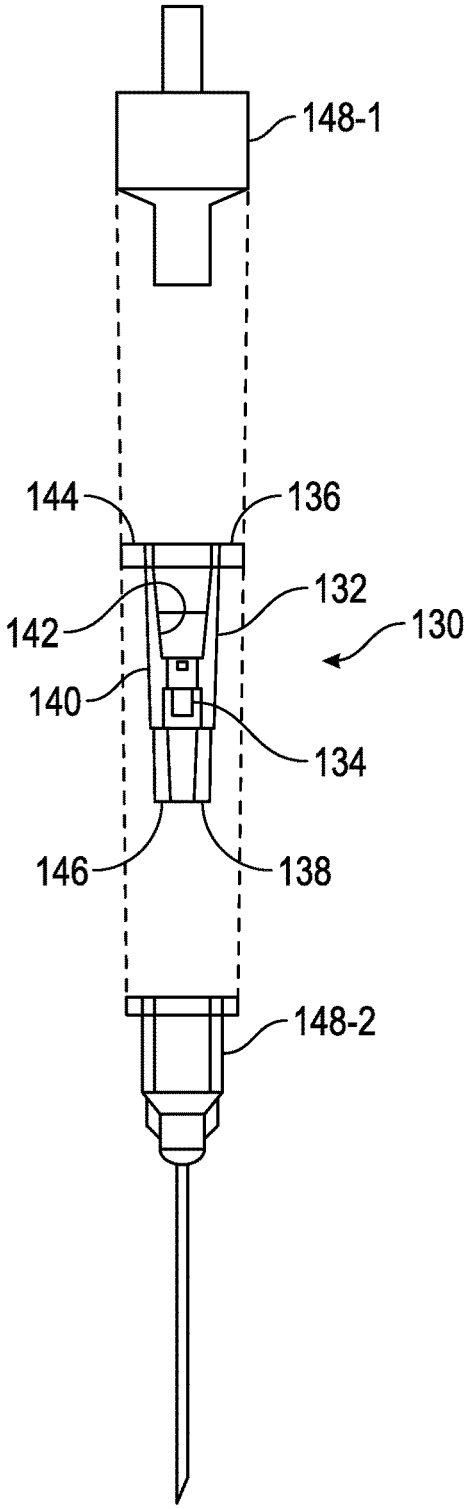
FIG. 11 shows an exploded view of a diluent tip with a needle adapter in accordance with some embodiments of the present disclosure.

Referring now to FIG. 11, therein shown is a diluent tip 130, according to some embodiments of the present disclosure. The diluent tip 130 comprises a tube 132 and a capillary 134 positioned within the tube 132. The tube 132 may include a first end 136, a second end 138 opposite the first end 136, a sidewall 140 extending between the first end 136 and the second end 138 and defining an interior cavity 142. The tube 132 may include a first connection member 144 proximate to the first end 136 and a second connection member 146 proximate to the second end 138. The first connection member 144 and the second connection member 146 may be threaded connection members, friction fit connection members, or any other suitable connection members. In some embodiments, the first and second connection members 144 and 146 are configured to connect the tube 132 to a needle adapter 148-1 and 148-2, respectively. The capillary 134 may be similar to the capillary 106, described above and may have a predetermined volume, such as between 1 μL and 5 μL, for example.

Figure 12:
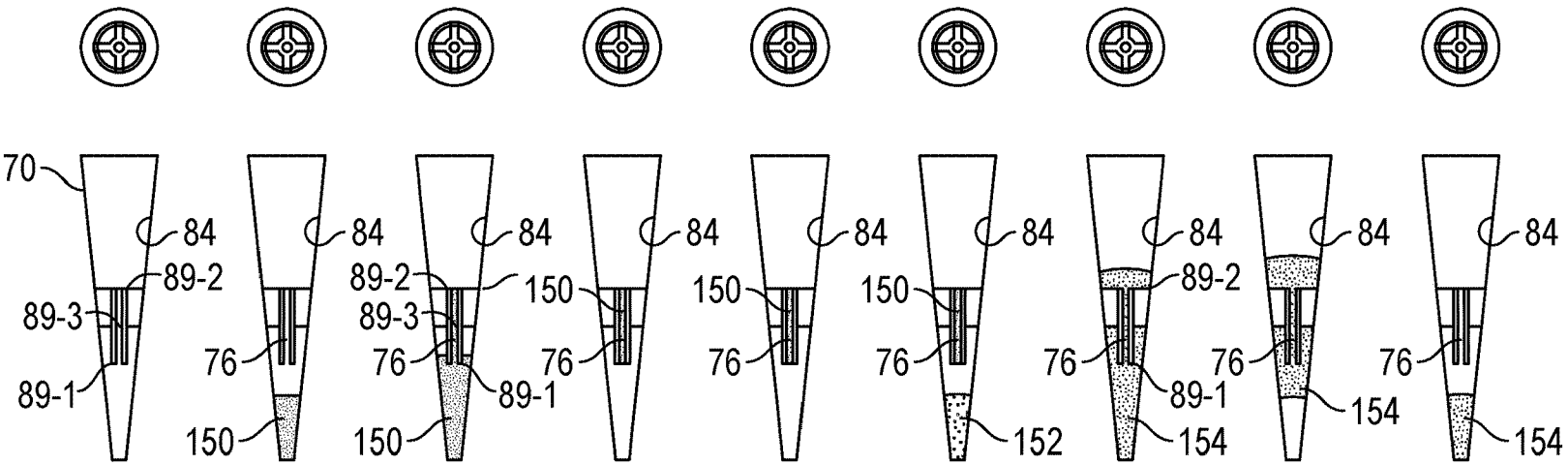
FIG. 12 shows a method of using the pipette of FIG. 7, in accordance with some embodiments of the present disclosure.
Figure 13:
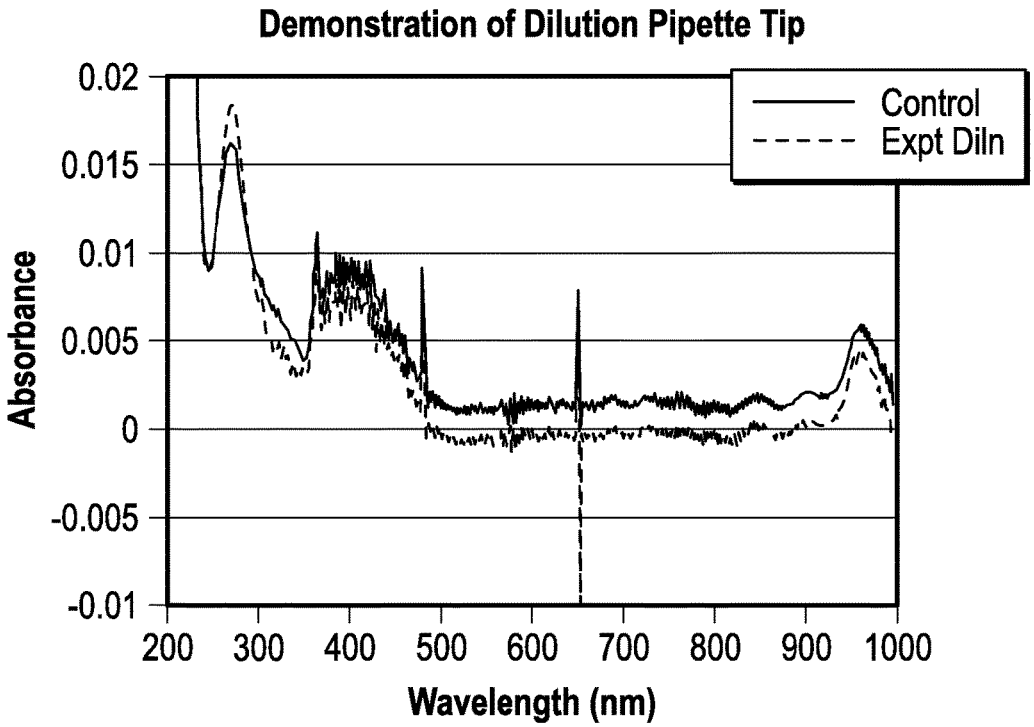
FIG. 13 is a graph showing a spectra obtained from a spectroscopic demonstration of a control sample and a sample produced with the method depicted in FIG. 12.

Referring now to FIG. 12, therein shown is a method for using a pipette, in accordance with some embodiments of the present disclosure to perform serial dilutions with one or more diluents to form a solution. The method depicted in FIG. 12 may be used with the pipette 70, the diluent pipette tip 100, or the diluent tip 130, for example. However, for clarity, the method will be described with reference to the pipette 70. The method may be performed by drawing a sample 150 of liquid/fluid into the interior cavity 84 of the pipette 70 to contact the capillary end 89-1 of the capillary 76 positioned within the interior cavity 84 such that a known volume of the sample 150 is drawn into the bore 89-3 of the capillary 76. The remainder of the sample 150 may be expelled from the interior cavity 84 of the pipette 70 while maintaining the known volume of the sample 150 within the capillary 76. A known volume of a diluent 152 may be introduced into the interior cavity 84 of the pipette 70 such that the diluent 152 contacts both of the capillary ends 89-1 and 89-2 of the capillary 76 within the interior cavity 84. Introducing the diluent 152 into the interior cavity 84 to contact both ends of the capillary ends 89-1 and 89-2 causes the capillary 76 to release the capillary force thereby introducing the known volume of the sample 150 into the known volume of diluent 152. The method may further be performed by expelling the diluted sample 156 from the interior cavity 84 of the pipette 70. Mixing the known volume of the diluent 152 and the known volume of the sample 150 may be performed by cycling the known volume of the diluent 152 and the known volume of the sample 150 within the interior cavity 84. Cycling the known volume of the diluent 152 and the known volume of the sample 150 may be performed by a combination of suction and pressure cycles applied to the interior cavity 84 of the pipette 70. For example, the combination of suction and pressure cycles may be applied by partially compressing and partially decompressing the pressure mechanism 74.

CONCLUSION

In light of the foregoing, one skilled in the art will understand that the presently disclosed inventive pipettes are an advance over known pipettes. With respect to the embodiments of FIGS. 1-6, the pipette 10 and the reagent pipette tip 30 perform a function such as conducting a chemical analysis of some of the properties of a sample in an efficient and orderly fashion without having to pour the sample from a collection container into a separate test tube. With respect to the embodiments of FIGS. 7-12, the pipette 70, the diluent pipette tip 100, or the diluent tip 130 can be used to dilute a liquid/fluid with a single device thereby unitizing the dilution process. The pipette 70, the diluent pipette tip 100 and the diluent tip 130 present options for a dilution processes which can be used to increase user convenience, decrease number of disposables or ease automated operations.

Further, although the tubes 12, 32, 72, 102, and 132 can be constructed of materials that are transparent to light within the visible spectrum, it should be understood that the tubes 12, 32, 72, 102 and 132 can also (or alternatively) be transparent to light within non-visible spectrums, such as the infra-red spectrum or the ultraviolet spectrum.

Although the preceding description has been described herein with reference to particular means, materials and embodiments, it is not intended to be limited to the particulars disclosed herein; rather, it extends to functionally equivalent structures, methods, and uses, such as are within the scope of the appended claims.

What is claimed is:

1. A diluent pipette tip, comprising:

a tube having a first end, a second end opposite the first end, and a sidewall extending between the first end and the second end defining an interior cavity, a connection member of the tube configured to be connected to a pipette such that when a sample is drawn into the pipette, the sample is drawn in a liquid path through the tube;

a capillary holder positioned within the interior cavity of the tube and in the liquid path, the capillary holder having a capillary receiving area and a plurality of connectors extending outwardly relative to the capillary receiving area and connecting with the sidewall of the tube, the connectors spaced apart such that a channel is formed between each adjacently disposed pair of connectors; and a capillary positioned within the capillary receiving area and in the liquid path.

2. The diluent pipette tip of claim 1, wherein the connection member of the tube is proximate to the first end for connecting the tube to the pipette.

3. The diluent pipette tip of claim 2, wherein the connection member of the tube is a threaded connection member.

4. The diluent pipette tip of claim 1, wherein the capillary has a bore with a predetermined volumetric space between 1 μL and 5 μL.

5. A diluent tip, comprising:

a tube having a first end, a second end opposite the first end, a sidewall extending between the first end and the second end defining an interior cavity and a connection member configured to connect the tube to a pipette; and a capillary suspended within the interior cavity and connected to the sidewall with a capillary holder, the capillary holder having a channel to permit fluid to flow past the capillary holder, the channel being an opening that is outside of the capillary.

6. The diluent tip of claim 5, wherein the connection member is a first connection member proximate to the first end and wherein the tube further comprises a second connection member proximate to the second end.

7. The diluent tip of claim 6, wherein the first connection member and the second connection member are threaded connection members.

8. The diluent tip of claim 6, wherein the first connection member and the second connection member are configured to connect the tube to a needle adapter.

9. The diluent tip of claim 5, wherein the capillary has a bore with a predetermined volumetric space between 1 μL and 5 μL.

* * * * *